US006224232B1

(12) United States Patent
Rodriguez

(10) Patent No.: US 6,224,232 B1
(45) Date of Patent: May 1, 2001

(54) HOLIDAY LIGHT STRING COVERING SYSTEM

(76) Inventor: Greg Rodriguez, 14561 Pony Trail Rd., Victorville, CA (US) 92392

( * ) Notice: Subject to any disclaimer, the term of this patent is extended or adjusted under 35 U.S.C. 154(b) by 0 days.

(21) Appl. No.: 09/273,910

(22) Filed: Mar. 22, 1999

(51) Int. Cl.[7] ..... F21S 4/00; F21V 21/00

(52) U.S. Cl. ..... 362/145; 362/248; 362/249; 362/374

(58) Field of Search ..... 362/240, 248, 362/249, 374, 375, 391, 145

(56) References Cited

U.S. PATENT DOCUMENTS 4,511,953 * 4/1985 Fage ..... 362/374
4,965,704 * 10/1990 Osborne, Sr. ..... 362/249
5,311,414 * 5/1994 Branham, Sr. ..... 362/249
5,594,628 * 1/1997 Reuter et al. ..... 362/249
5,816,687 * 10/1998 Tapp ..... 362/248
5,860,731 * 1/1999 Martinez ..... 362/249

* cited by examiner

*Primary Examiner*—Alan Cariaso
(74) *Attorney, Agent, or Firm*—Goldstein & Canino

(57) ABSTRACT

A light covering system for use in permanently attaching a holiday light string onto a building structure, and selectively seasonally displaying or concealing the light string. A housing includes a fixed portion and a cover. The fixed portion includes a back plate which is mounted directly to the building structure, a hood, and end plates. The string light extends taut between the end plates so that it does not contact any other portion of the housing. The cover is hingeably attached to the fixed portion so that it may selectively enter a closed position wherein the light string is concealed, and an open position for displaying the light string. A latch selectively holds the cover in the closed position until it is released by pressing a release button.

1 Claim, 2 Drawing Sheets

HOLIDAY LIGHT STRING COVERING SYSTEM

BACKGROUND OF THE INVENTION

The invention relates to a holiday light string covering system. More particularly, the invention relates to a system for covering holiday light strings mounted upon a structure, so that the light strings can remain attached to the structure year-round.

Holiday light displays are commonly installed along the roofline, and around the windows and doorways of residential and commercial structures. These assemblies usually comprise lengthy strings of weatherproof light bulbs which are fastened to the fascia of the building or under the roof line by means of nails, staples or other suitable semi-permanent fasteners. As the celebrated holiday season passes, it is common practice to remove these light displays and store them indoors rather than leave them installed and un-illuminated until the next holiday. Upon so removing these assemblies, however, the fascia of the building is often marred and damaged due to the removal of the semi-permanent fasteners such as nails or staples. The constant installment and removal of these assemblies over the course of several years (which tends to consume great amounts of time) also manages to seriously damage the structure and degrade it's appearance.

A device is needed which dispenses with the requirement of installing and removing holiday light assemblies several times a year. Such a device would preferably provide an attractive light assembly which is concealable during non-holiday periods and thus need not be removed. This device should further protect the light assembly from year-round inclement weather to ensure it's proper operation during holiday seasons.

While these units may be suitable for the particular purpose employed, or for general use, they would not be as suitable for the purposes of the present invention as disclosed hereafter.

SUMMARY OF THE INVENTION

The present invention relates to a holiday light string assembly covering system, for concealably installing a string of holiday lights upon a residential or commercial structure during non-holiday seasons, such that a series of lights contained beneath the cover can be exposed during desired holidays.

In accordance with the invention, there is provided a holiday lighting string assembly which is permanently secured to a building structure, which is selectively covering by the light string covering assembly, which is designed to expose a light string of a plurality of decorative light bulbs during desired holiday seasons and then conceal said light bulbs during non-holiday seasons.

Further in accordance with the invention, there is provided a holiday light string assembly covering system which is capable of safely concealing the plurality of holiday light bulbs which are contained in the light string during non-holiday seasons and protecting said bulbs from detrimental weather.

Further in accordance with the invention, there is provided a holiday lighting assembly which possess a rigid cover which may be installed over the lights during non-holiday seasons to conceal and protect the plurality of light bulbs located therebehind.

The invention is a light covering system for use in permanently attaching a holiday light string onto a building structure, and selectively seasonally displaying or concealing the light string. A housing includes a fixed portion and a cover. The fixed portion includes a back plate which is mounted directly to the building structure, a hood, and end plates. The string light extends taut between the end plates so that it does not contact any other portion of the housing. The cover is hingeably attached to the fixed portion so that it may selectively enter a closed position wherein the light string is concealed, and an open position for displaying the light string. A latch selectively holds the cover in the closed position until it is released by pressing a release button.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
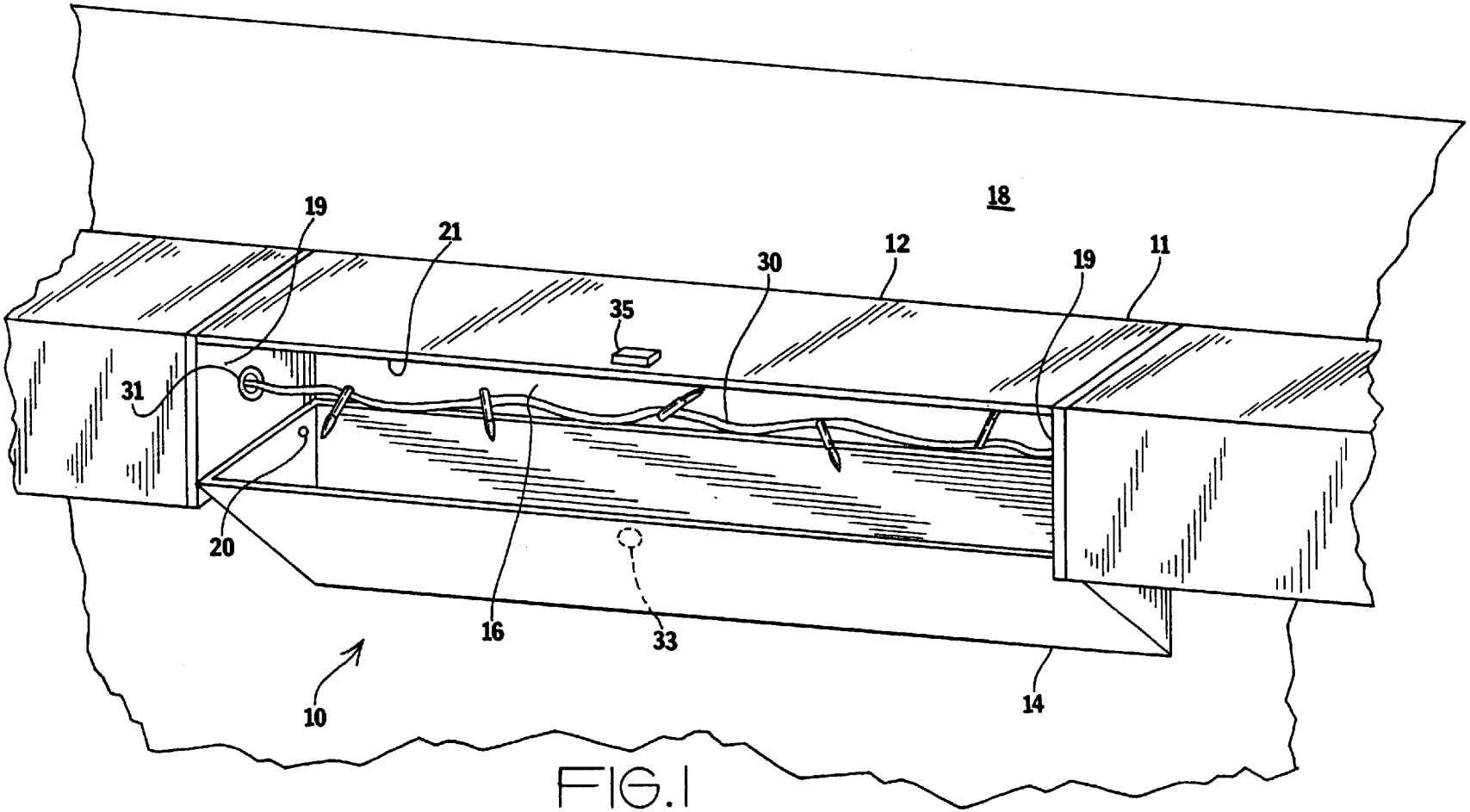
FIG. 1 is a front elevational view, illustrating the invention, wherein the cover is lowered to reveal the lights extending through the housing.

FIG. 1 illustrates a light covering system 10, comprising a housing 11. The housing 11 comprises a fixed portion 12 and a cover 14. The fixed portion 12 comprises a back plate 16 which mounts directly to a building structure 18. The fixed portion 12 has a pair of end plates 19. The cover 14 is hingeably mounted to the fixed portion 12 with a pair of hinges 20 which are located at the end plates 19.

A light string 30 extends within the housing 11 between the end plates 19. The light string 30 is preferably taut between the end plates 19, so that it does not contact any portion of the housing, other than the end plates 19. The end plates 19 have grommets 31, through which the light strings 30 extend. The grommets 31 are preferably made of rubber. Thus, the light string 30 is electrically isolated from the housing 11 and the building structure. Even if there is an insulation breakdown on the light string 30, the housing will remain electrically inactive and safe to the user. The fixed portion 12 of the housing 11 includes a hood 21 which helps shield the light string 30 from precipitation. The hood 21 is perpendicular to the back plate 16.

Figure 2:
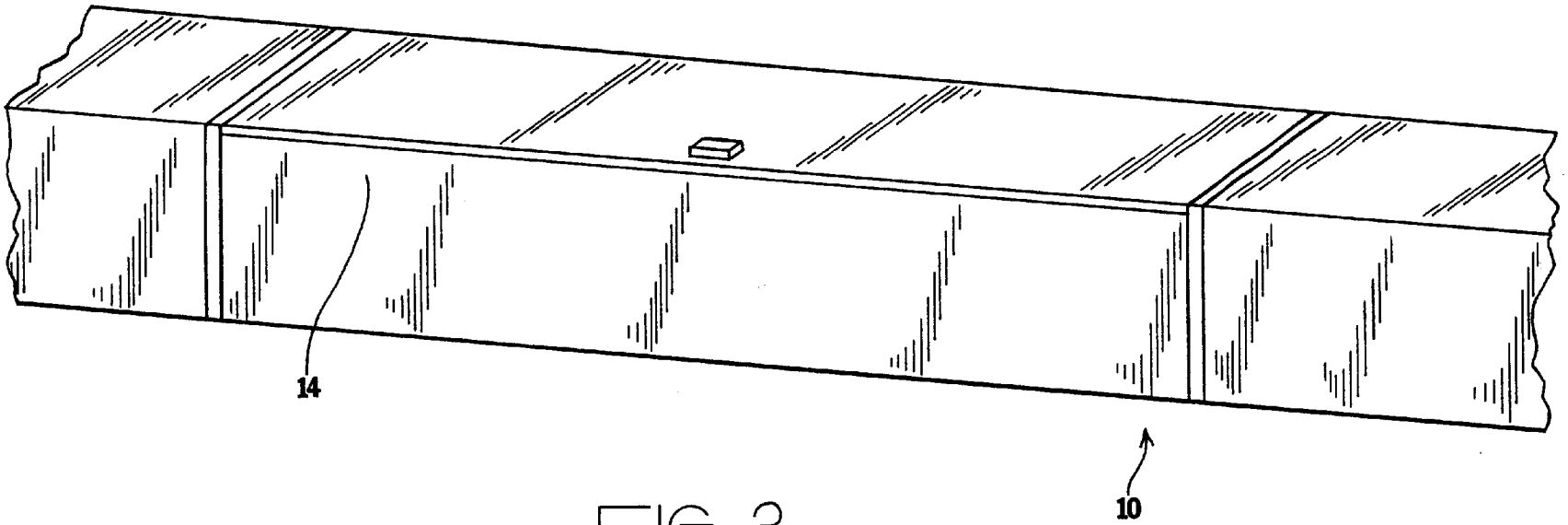
FIG. 2 is a front elevational view, illustrating the invention, wherein the cover is raised to disguise the light strings during non-holiday seasons.

FIG. 2 illustrates the light covering system 10, wherein the cover 14 is in a closed position, effectively concealing the light string within.

Referring back to FIG. 1, a latch mechanism helps maintain the cover 14 in the closed position. The latch mechanism comprises a catch 33 on the cover 14 and a release button 35 on the fixed portion 12. When the cover 14 is in the closed position, the catch 33 and release button 35 interact to hold the cover 14 closed. The cover 14 is selectively released so that it may enter the open position illustrated in FIG. 1 by pressing the release button 35.

According to the present invention, the back plate of the fixed portion 12 of the housing 11 is permanently mounted to a building structure vertical surface. The light string 30 is extended between the end plates. Additional light covering systems 10 can be mounted side by side, with the end plates abutting each other, so that the grommets 31 are aligned.

During the holiday season, the release button 35 is pressed and the cover 14 is opened to reveal the light string 30. Even when the cover 14 is open, the hood 21 protects the light string 30 from inclement weather. However, during non-holiday seasons, the cover 14 is closed, and the light string 30 is concealed from view and is well protected from the elements.

In conclusion, herein is presented a holiday light covering system which allows light strings to be permanently mounted to a building structure, wherein the light strings are covered during non-holiday times, and are revealed during the holiday season.

What is claim is:

1. A light covering system, for selectively displaying light strings on a building structure, comprising:

a housing having a fixed portion and a cover;

the fixed portion has a back plate which is mounted to the building structure, end plates and a hood which are perpendicular to the building structure, and the light string extends between the end plates, wherein the end plates have grommets centered in the end plates, and the light strings extend through the grommets and are pulled taut between the end plates so that the light strings do not make physical contact with any portion of the housing other than the grommets;

the cover is hingeably attached to the fixed portion such that the cover is pivotable between a closed position wherein the light string is concealed from view and an open position for displaying the light string;

a latch for selectively holding the cover in the closed position, and releasing to allow the cover to enter the open position.

* * * * *